United States Patent [19]

Schmidt

[11] 4,322,099

[45] Mar. 30, 1982

[54] CLAMPING CLOSURE FOR THE RELEASABLE JOINING OF THE LOCKING STRIP OF CASES, WRITING CASES AND THE LIKE

[75] Inventor: Günther Schmidt, Baden-Baden, Fed. Rep. of Germany

[73] Assignee: The Parker Pen Company, Janesville, Wis.

[21] Appl. No.: 101,245

[22] Filed: Dec. 7, 1979

[30] Foreign Application Priority Data

Dec. 28, 1978 [DE] Fed. Rep. of Germany ..... 2856423

[51] Int. Cl.[3] ..... E05C 17/52

[52] U.S. Cl. ..... 292/19; 272/DIG. 50

[58] Field of Search ..... 292/17, 19, 128, 204, 292/213, 256.65, 303, 353, DIG. 38, DIG. 50, 91; 24/213 R, 214, 215

[56] References Cited

U.S. PATENT DOCUMENTS

| | | | |
|---|---|---|---|
| 1,305,233 | 5/1919 | Ogden | 24/215 |
| 1,320,496 | 11/1919 | Roth | 24/214 |
| 1,323,950 | 12/1919 | Bauer | 24/214 |
| 1,325,577 | 12/1919 | Pilkington | 24/214 |
| 1,337,115 | 4/1920 | Carr | 24/215 |
| 1,757,424 | 5/1930 | Goss | 24/213 CS |
| 1,840,785 | 1/1932 | Moore et al. | 292/DIG. 39 |
| 1,847,228 | 3/1932 | Smith | 292/17 X |
| 2,320,992 | 6/1943 | Widmer | 292/256.65 X |
| 2,737,407 | 3/1956 | Matthews et al. | 292/128 |
| 2,943,879 | 7/1960 | Allen | 292/DIG. 41 |
| 3,329,767 | 7/1967 | Lindsey et al. | 248/219.4 X |
| 4,035,874 | 7/1977 | Liljendahl | 24/213 R X |
| 4,222,595 | 9/1980 | Schmidt | 24/214 |

FOREIGN PATENT DOCUMENTS

| | | | |
|---|---|---|---|
| 20647 | of 1891 | United Kingdom | 292/213 |

*Primary Examiner*—Richard E. Moore

*Attorney, Agent, or Firm*—Bacon & Thomas

[57] ABSTRACT

Clamping closure for the releasable joining of a closing strip of cases, writing cases and the like, with the main body of structures of this type. A lower part has a spring and an upper part is provided, which is in releasable locking engagement with the spring when the two parts are pressed together. The lower part is in the form of a base plate provided with two grooves arranged on a circular circumference and including two webs in opposition to each other, a cap equipped with two protrusions corresponding to the two grooves and joinable with the base plate by pressing the projections into the grooves; the cap also being slit in the area of the webs and otherwise having a partially cylindrical circumference, a slit annular spring with two opposing circumferential shoulders, which in the areas of the webs springingly protrude over the external periphery of the cap in a radial direction while the upper part has a clamping plate with a circular orifice essentially corresponding to the external diameter of the cap. The edge of the orifice facing the lower part defines an annular shoulder to depress the circumferential protrusions of the annular spring and to lock between the protrusions and the base plate.

3 Claims, 5 Drawing Figures

CLAMPING CLOSURE FOR THE RELEASABLE JOINING OF THE LOCKING STRIP OF CASES, WRITING CASES AND THE LIKE

BACKGROUND OF THE INVENTION

The invention concerns a clamping closure for the releasable joining of the locking strip of cases, writing cases, and the like, wherein the main body of structures of this type have a lower part comprising a spring and an upper part which, upon the pressing together of the upper and the lower part, lockingly and releasably engages said spring.

German Pat. No. 27 38 122 concerns a clamping connection wherein a base plate of a lower part is provided with four perforations arranged on a circular circumference and enclosing strips opposing each other in pairs. The lower part of the clamping closure according to German Pat. No. 27 38 122 further comprises a cap equipped with four lugs corresponding to the perforations of the base plate, with said cap being joined to the base plate by pressing the lugs into the perforations. Outside the area of the strip, the cap has a semicylindrical peripheral wall with a height less than that of the lugs, wherein the peripheral wall is perforated to the covering surface of the cap between two closely adjacent lugs. Circumferential projections of a slit annular spring set into the cap protrude through these perforations so that in the web areas, after the assembly of the lower part, protrude radially and springingly past the outer circumference of the cap. The upper part of the clamping closure comprises a clamping plate provided with a circular opening essentially corresponding to the diameter of the cap, while on the opening edge facing the lower part a spring projection is provided for the purpose of depressing the circumferential projections of the annular spring for the locking engagement of said annular spring with the base plate.

The known clamping closure is extremely convenient and reliable in practical use. Certain disadvantages have, however, arisen from the fact that the four small projections of the cap may break off under extreme stress exposures, so that the joint between the cap and the base plate is partially susceptible to release or damage in a detrimental manner.

SUMMARY OF THE INVENTION

It is therefore the object of the present invention to develop a clamping closure of the above-mentioned type to assure the reliable fastening of the cap on the base part and thus the safe locking of the spring of the clamping closure.

According to the invention, the object is attained in a clamping closure by a lower part which comprises a base plate provided with two grooves arranged on a circular circumference and including webs opposing each other, a cap equipped with two projections into said grooves, the cap being slit in the area of the webs and otherwise having a partially cylindrical peripheral wall, and a slit annular spring with two circumferential projections, which in the area of the webs protrude radially and springingly over the outer circumference of the cap in the areas of the webs after the assembly of the lower part. The upper part comprises a clamping plate with a circular orifice essentially corresponding to the external diameter of the cap, while on the opening edge facing the lower part an annular projection for the depression of the peripheral projections of the annular spring and their locking with the base plate, is provided.

Preferred forms of embodiment of the invention are characterized in that the projections of the cap are held securely and positively in the grooves of the base plate and/or the cap is joined with the base part by means of projections secured in the grooves, wherein the latter embodiment is further improved in that the cap is welded into the grooves of the base part by means of the projections, or the projections are adhesively bonded in the grooves.

According to the invention, the joint between the base plate and the cap is thus improved in that, in the base plate, two nearly semicircular grooves are provided into which two projections, corresponding to the shape of the grooves and thus nearly semicircular, of the cap may be inserted.

Peripheral projections of the annular spring, located in the cap, protrude through the orifices opposing each other in the cylindrical sidewall of the cap, and extend between the two nearly semicircular projections of the cap, over the webs of the base plate between the nearly semicircular grooves whereby clamping engagement with the clamping plate is made possible. The overall result is that the nearly semicircular projections of the cap are highly stable and cannot be broken off during the normal use of the closure, so that a reliable and strong closure between the cap and the base part is obtained.

BRIEF DESCRIPTION OF THE DRAWINGS

Further characteristics and advantages of the invention may be found in the claims and the description hereinafter, wherein an example of embodiment is explained in detail with the aid of the drawing.

In the drawing.

DESCRIPTION OF A PREFERRED EMBODIMENT

Figure 1:
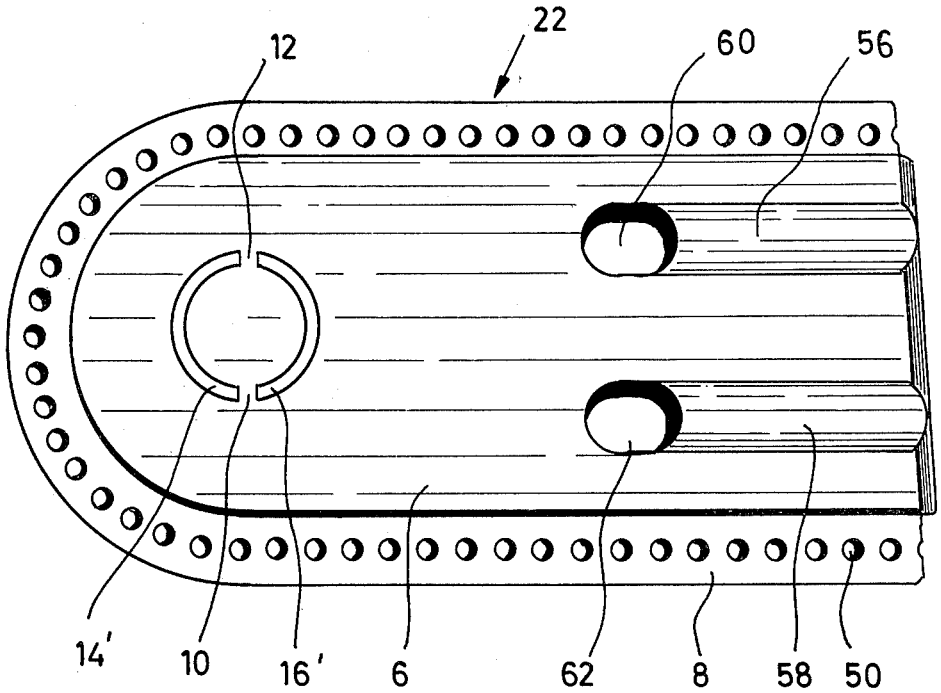
FIG. 1 shows an embodiment of the base plate of the lower part from its side facing the clamping plate.

The Embodiment of the base plate 22 shown in FIG. 1 is intended as the bottom part of cases for writing instruments, whereby the case equipped with said bottom part is capable of receiving and holding two writing instruments. The base plate 22 shown has a central part 6 and a peripheral rim 8 circumferentially surrounding the center part 6 with the exception of one side, said rim 8 being offset in the manner of a shoulder. The base plate 22 is equipped with two nearly semicircular grooves 14' and 16' arranged on a circular circumference and separated by two webs 10, 12, said grooves having essentially rectangular cross sections.

Figure 2:
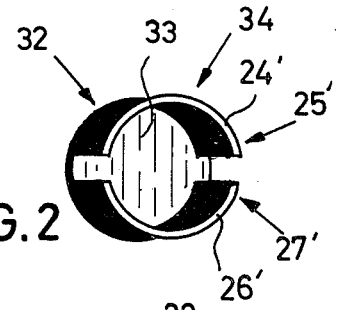
FIG. 2 shows the cap to be placed on the base plate.
Figure 3:
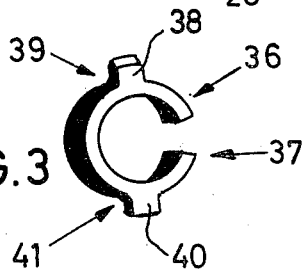
FIG. 3 shows the annular spring to be inserted in the cap.

In FIG. 2 a cap 34 is shown, said cap having a peripheral wall with two projections 24', 26', corresponding to the grooves 14', 16' and thus also nearly semicircular, extending perpendicular to the cover surface 33 of the cap 34. Between the nearly semicircular projections 24', 26', the circumferential wall 32 is broken through to the cap surface 33 on two exactly opposite sides. The peripheral projections 38, 40 of the annular spring 36 to be inserted in the cap 34 and shown in the FIG. 3, to project outwardly of the cap between the projections 24', 26'. The annular spring 36 is not a fully circular annulus but is cut at 37 so that it may be compressed by forces acting on the peripheral projections 38, 40, so that the latter may be retracted in the inward direction.

To regulate the forces to be applied to the opening and closing of the clamping closure, the peripheral projections in the embodiment shown are bevelled unilaterally by means of the bevels 39, 41 from the edge of the annular spring 36 toward their ends.

Figure 4:
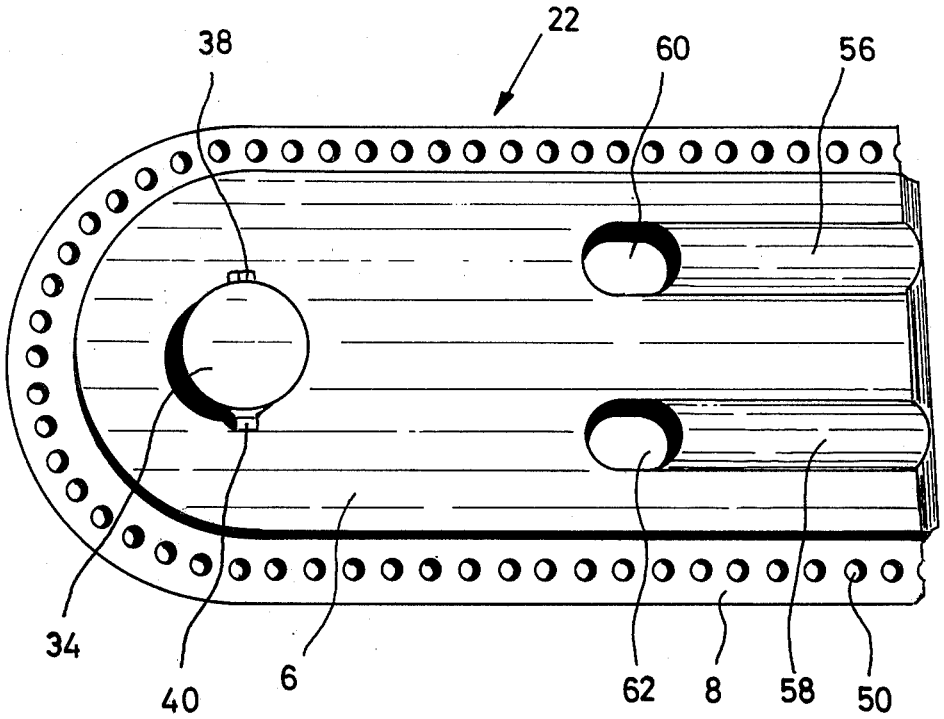
FIG. 4 shows the assembled lower part.

FIG. 4 shows the assembly of the base plate, the cap 34 and the annular spring 36. The peripheral projections 38, 40 protruding from the cap of the annular spring 36 are clearly visible. To secure the assembly, the edges 25', 27' of the projections 24', 26' are solidly welded into the grooves 14', 16'.

Figure 5:
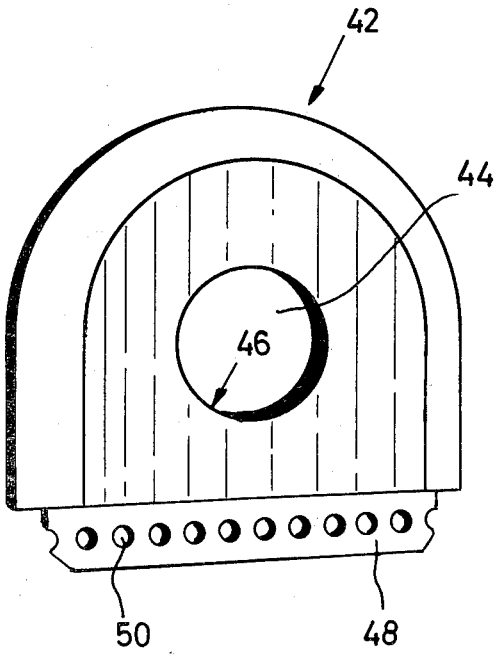
FIG. 5 shows the clamping plate.

A clamping plate 42 of the upper part of the clamping closure according to the invention is shown in FIG. 5, wherein the clamping plate 42 has a circular orifice 44 corresponding essentially to the outer diameter of the cap 34 and provided at its opening edge with an annular shoulder 46 for the depression of the circumferential projections 38, 40 of the annular spring 36 and to lock between said circumferential projections and the base plate 22. The illustrated embodiment of the clamping plate 42 is essentially semicircular in its configuration and slightly flattened at its semicircular circumference, while at the straight line end of the clamping plate 42 a shoulder 48 having less thickness than the clamping plate 42 is located, which, together with the peripheral edge of the lower part, is equipped with sewing eyelets 50, whereby both the upper part and the lower part may be sewn to the material of the case, for example, leather or a leather-like synthetic material. In practical applications, the lower part and the upper part of the clamping closure according to the invention are sewn into a case by means of the sewing eyelets 50, so that in order to close the case, the upper part joined to a strip of the case may be firmly pressed onto the lower part, so that the circumferential projections 38, 40 of the annular spring 36 hook into the annular shoulder 46 of the circular orifice 44 of the clamping plate 42 of the upper part. By means of suitably altered lower parts, the upper part and lower part may be sewn into other objects, such as writing pads and the like, so that the clamping closure according to the invention may be used there also. In this manner, the clamping closure of the invention may be used in cases of numerous types, for example, for writing cases for one or several writing instruments wherein the lower part shown is provided on its side facing the upper part with grooves 56, 58 for the insertion of the spring clamp of the writing instruments, with the thickened end of said writing instruments extending into the orifices 16, 62 shown. Different layouts of the lower part of the clamping closure of the invention may also be used for credit card cases and the like.

The characteristics of the invention disclosed in the description presented hereinabove may be modified while still falling within the scope of the appended claims.

What is claimed is:

1. A clamping closure for the releasable joining of a closing strip for cases, writing cases and the like with the main body of the case, said closure having a lower part comprising a spring and an upper part which may be engaged in locking engagement with said spring, characterized in that the lower part comprises a base plate (22) provided with a single pair of opposed continuous grooves (14', 16'') and one pair of opposed webs (10, 12), the pairs of grooves and webs being peripherally arranged and completing a full circle, a cap (34) equipped with two projections (24', 26') corresponding to the grooves (14', 16') and joined to the base plate (22) by frictional force with the projections (24', 26') being spaced in the area of the webs (10, 12) and otherwise having a cylindrical circumferential wall (32), also a slit annular spring (36) in the cap with two circumferential shoulders extending from the spaces between the webs and being resiliently and radially compressible; the upper part of the closure comprising a clamping plate (42) with a circular orifice (44) essentially corresponding to the external diameter of the cap (34), wherein on the edge of the orifice facing the lower part an annular shoulder (46) is provided to radially compress the circumferential projections (38, 40) of the annular spring (36) and to lock between the said annular spring and the base plate (22).

2. A clamping closure according to claim 1, wherein said cap (34) is solidly connected with the base plate (22) by means of the projections (24', 26') secured in the grooves (14', 16') of the base plate (22).

3. A clamping closure according to claim 1 or 2, wherein said cap (34) is welded in the grooves (14', 16') of the base part (22) by means of the projections (24', 26').

* * * * *